United States Patent [19]

Seynhaeve

[11] 4,244,452

[45] Jan. 13, 1981

[54] SUITCASE WITH ROLLERS

[75] Inventor: André G. Seynhaeve, Senlis, France

[73] Assignee: Societe Delsey, Bobigny, France

[21] Appl. No.: 68,339

[22] Filed: Aug. 21, 1979

[30] Foreign Application Priority Data

Oct. 30, 1978 [FR] France ..... 78 30729

[51] Int. Cl.[3] ..... A45C 5/14

[52] U.S. Cl. ..... 190/18 A

[58] Field of Search ..... 190/18 A; 280/47.26, 280/47.24, 47.17

[56] References Cited

U.S. PATENT DOCUMENTS 3,163,268 12/1964 Leavell ..... 190/18 A

*Primary Examiner*—Donald F. Norton

*Attorney, Agent, or Firm*—Oblon, Fisher, Spivak, McClelland & Maier

[57] ABSTRACT

A suitcase which includes two shells and at least two rollers disposed in housings provided in the outer face of the shells, so as to project outwardly wherein each roller is disposed in its housing between two complementary members forming an added box, and is rotatably mounted inside the latter, on a shaft extending between these two complementary members, and a securing member being provided for maintaining the box in the housing, inside the shells, while interlocking the component parts thereof.

8 Claims, 4 Drawing Figures

SUITCASE WITH ROLLERS

BACKGROUND OF THE INVENTION

1. Field of the Invention

The present invention relates to a suitcase including two shells and at least two rollers disposed in housings provided in the outer face of the shells, so as to project outwardly.

2. Description of the Prior Art

The solutions proposed at present for mounting the rollers on the cases do not provide complete satisfaction for they often complicate the manufacturing operations and are for this reason the source of a substantial increase in the cost of the suitcase. Such lead furthermore to a weakening of the shells, in the portions thereof receiving the rollers, so that it frequently occurs that the suitcases are damaged by violent impacts to which they are usually subjected during transport, particularly by air.

SUMMARY OF THE INVENTION

The present invention proposes remedying these disadvantages and, for this reason, provides a suitcase with rollers which is characterized in that each roller is disposed in its housing between two complementary members forming an added box, and is rotatably mounted inside the latter, on a shaft extending between the two complementary members, a securing member being provided for maintaining the box in the housing, inside the shells, while rigidly locking together its component parts.

With this arrangement, the number of parts required for mounting the rollers is reduced to the minimum. The same applies moreover, for the operations which must be made for this mounting during manufacture.

Preferably, the shaft of the roller is integrally formed with one of the two complementary members forming the box, which further simplifies the mounting operations. Advantageously, one of the complementary members forms the bottom and the sidewall of the box and is outwardly shaped so as to come into intimate contact with the outer face of the housing.

The box enclosing the roller thus exactly fits the housing inside which it is perfectly held in position, so that there is no risk of its moving accidently under the weight of the articles contained in the suitcase.

Preferably, the member forming the bottom and sidewall of the box includes, in the portion thereof forming the sidewall of the box, a double wall defining a channel in the entrance of which is fitted a correspondingly shaped rib formed on the other member which constitutes the lid of the box.

The double wall has the obvious advantage of increasing the strength of the case. Its channel, by receiving the rib, allows moreover the two component parts of the box to be fitted securely and rapidly.

According to a special arrangement, the channel is interrupted by strengthening cross walls defining cavities to the bottom of some of which extend protuberances carried by the rib. According to another arrangement, the member forming the bottom and sidewall of the box includes, in the portion thereof forming the bottom of the box, an external boss housed in a correspondingly shaped bore formed in the wall of the housing. This member may thus be held in the housing even more satisfactorily.

Preferably, the outer face of the housing is lined with an added wall element which is held thereagainst by securing member. It will be readily understood that the shells are reinforced in the regions thereof which are usually fragile, which thus contributes to better protection of the suitcase against possible damage caused during transport.

Advantageously, the securing member constitutes a pin having a head bearing against the added wall element, this pin passing through the two complementary members at the axis of the roller in which it is force fitted. It will be readily understood that the interlocking of the two members forming the case and the fixing thereof in the housing are provided in a simple but secure way.

Preferably, the securing members are formed by other pins having a head bearing against the added wall element and which pass through the complementary members at the level of the protuberances in which they are force fitted. These other pins reinforce, of course, the efficiency of the first one.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 2:
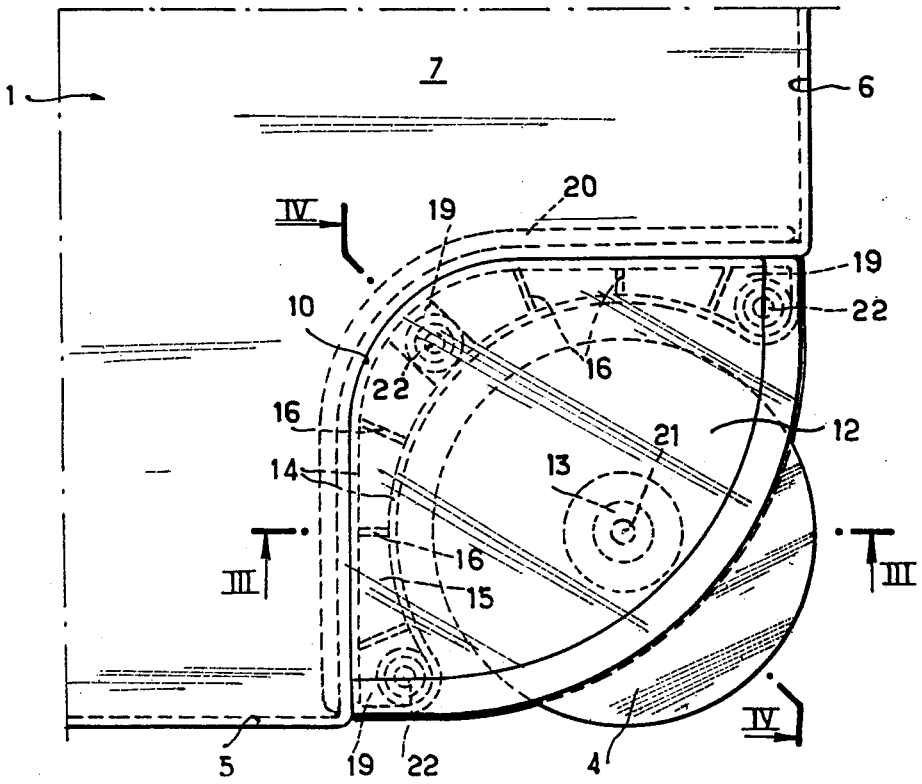
FIG. 2 is a partial front view on a larger scale of one of the two shells of the suitcase and shows the box containing the corresponding roller.
Figure 4:
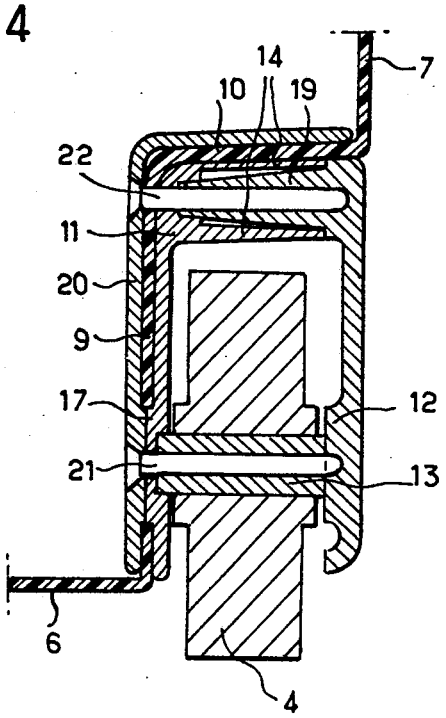

FIG. 4 is a sectional view along line IV—IV of FIG. 2.

Figure 1:
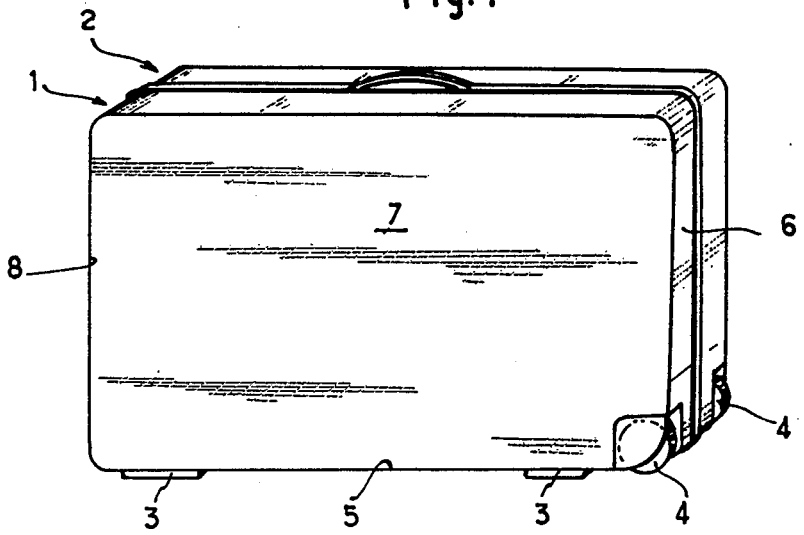
FIG. 1 is a schematic prespective view of a suitcase in accordance with the present invention.

Shells 1 and 2 of the suitcase shown in FIG. 1 are each provided with two feet 3 and a roller 4 disposed in a housing provided at the intersection of the lower longitudinal face 5 and the side face 6 of the suitcase. The rollers, which are parallel to the large faces 7 of the shells, project slightly outwardly but are not in contact with the ground when the suitcase rests on its feet 3. In fact, they only come into contact with the ground when the user raises the suitcase by means of the gripping rod (not shown), provided on the other side face 8 of the suitcase.

In the example shown, the shells are made of a plastic material. It is to be understood however that they could be made from any other material and, in particular, from metal.

Figure 3:
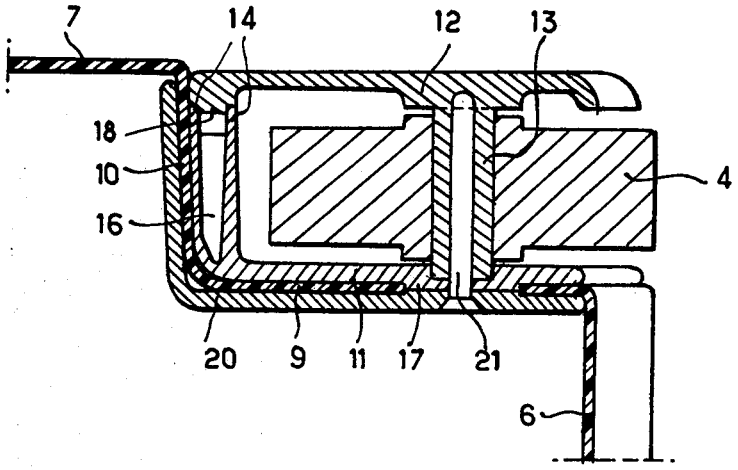
FIG. 3 is a sectional view along line III—III of FIG. 2.

The housing for roller 4, shown in FIGS. 2 to 4, includes a flat bottom 9 parallel to the large face 7 of shell 1 and a rounded front ledge situated at the intersection of faces 5 and 6 of the suitcase. It also includes a sidewall 10 rounded in its central portion, this wall being perpendicular to bottom 9 and connecting it to the large face 7 of shell 1.

The roller is disposed between two complementary members 11, 12, respectively forming a box whose dimensions correspond to those of the housing. It is rotatably mounted on a shaft 13 which is integral with member 12 and whose free end is retained in a correspondingly shaped recess formed in member 11.

As can be seen in the drawings, member 11 bears against the whole of the outer face of the housing. It forms the bottom of the box as well as the sidewall thereof which presents a wide aperture for passing the roller therethrough. In its portion forming the sidewall of the box, member 11 includes a double wall 14 defining a channel 15 interrupted here and there by strengthening cross walls 16. Furthermore, in the portion forming the bottom of the box, such includes a boss 17 housed in a correspondingly shaped bore formed in the bottom 9 of the housing.

Member 12 forms the lid of the box. Its outer face is substantially situated in the extension of the large face 7 of the shell and carries on its internal face a rib 18 whose shape corresponds to that of channel 15 in which it is fitted.

Referring more particularly to FIGS. 2 and 4, it will be noted that rib 18 has three protuberances 19 extending as far as the bottom of some cavities defined in the channel defined by the cross walls 16 and whose free ends are retained in appropriate recesses formed in member 11 (see FIG. 4).

So that it may resist possible damage caused by accidental impact, the shells are advantageously reinforced at the level of their housing. For this purpose, the inner face of each housing is lined with an added wall element 20.

The box is secured to the corresponding shell in a simple but secure way. This is achieved in fact, on the one hand, by means of a pin 21 which includes a head bearing against wall element 20, and which passes through members 11 and 12 at the level of shaft 13 supporting the roller and, on the other hand, by means of three pins 22 also includes a head bearing against wall element 20 and which pass through members 11 and 12 at the level of the protuberances 19.

It will be readily understood that pins 21 and 22, while securing the box in the housing, maintain members 11 and 12 so as to be perfectly housed one in the other. Since these pins are invisible and inaccessible from the outside, their presence does not affect the aesthetic aspect of the suitcase and fraudulent removal thereof is made impossible. Of course, the pins could, if neccessary, be replaced by screws or threaded rods, or by rivets. It goes without saying moreover that members 11 and 12, wall element 20 and roller 4 may be made from any material preferably from a plastic material.

The roller can be mounted very rapidly. All that is required in fact is to fit the roller on shaft 13 supported by member 12, to place member 11 against the outer face of the housing, fit over member 11 member 12 supporting the roller and place the pins 21 and 22.

The suitcase shown in FIG. 1 includes two rollers disposed at one of the lower corners thereof, these rollers each being supported by a shell whereas their axes are aligned perpendicular to the large faces 7 of the suitcase. It is, however, evident that the suitcase could include two rollers projecting from the lower longitudinal face of a single shell and be situated either one in the extension of the other, their axis being again perpendicular to the large faces 7, or parallel and having their axis parallel to the large faces. Similarly, the suitcase could include four rollers projecting from the inner longitudinal face thereof, for example at the lower corners thereof.

In all the different mounting possibilities which have just been mentioned, it is desirable for the rollers to come into contact with the ground only when the suitcase is brought to its wheeling position after being sufficiently inclined by the user.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A suitcase comprising:

two shells and at least two rollers disposed in housings provided in the outer faces of the shells, so as to project radially outwardly from said housings, first and second added boxes, first and second complementary members forming each added box within which one of said rollers is positioned, one of said first and second members of each box forming the bottom and the sidewall of the box and said one member being shaped so as to contact intimately an outer face portion of one of the housings;

a shaft extending between said first and second members of each box upon which said rollers are mounted; and means for securing said boxes in the housings so as to be positioned outside the shells and for interlocking said first and second members.

2. A suitcase according to claim 1, wherein each shaft is integrally formed with one of said first and second members.

3. A suitcase according to claim 1, the member forming the bottom and the sidewall of each box comprising, in the portion thereof forming the sidewall of the box, a double wall defining a channel and a corresponding shaped rib formed on the other member which constitutes a lid portion of the box fitted within said channel.

4. A suitcase according to claim 3, said rib further comprising a plurality of protuberences wherein the double wall channel is interrupted by strengthening cross walls defining cavities to the bottom of some of which said protuberences extend.

5. A suitcase according to claim 1, said housings each including a wall portion and said member forming the bottom and the sidewall of the box comprising, in the portion thereof forming the bottom of the box, a boss member housed in a correspondingly shaped bore formed in said wall portion of each housing.

6. A suitcase according to claim 1, each of said housings further comprising a wall element attached thereto by said securing means.

7. A suitcase according to claim 6, said securing means comprising at least one pin having a head portion bearing against said wall element, said pin interconnecting said first and second members along the axis of each roller.

8. A suitcase according to claim 7, said securing means comprising a plurality of pins each having a head portion bearing against said wall element.

* * * * *